US006313724B1

(12) United States Patent
Osterweil

(10) Patent No.: US 6,313,724 B1
(45) Date of Patent: Nov. 6, 2001

(54) MULTIFACETED BALANCED MAGNETIC PROXIMITY SENSOR

(76) Inventor: Josef Osterweil, 5411 Amberwood La., Rockville, MD (US) 20853

( * ) Notice: Subject to any disclaimer, the term of this patent is extended or adjusted under 35 U.S.C. 154(b) by 0 days.

(21) Appl. No.: 09/735,726

(22) Filed: Dec. 12, 2000

(51) Int. Cl.[7] ..... H01H 9/00
(52) U.S. Cl. ..... 335/207; 335/205
(58) Field of Search ..... 335/205–207, 335/151–154

(56) References Cited

U.S. PATENT DOCUMENTS 3,559,124 * 1/1971 Posey ..... 335/205
3,560,846 * 2/1971 Bessko ..... 335/207
4,319,712 * 3/1982 Bar ..... 335/205
4,331,013 * 5/1982 Jaulmes ..... 335/206
4,837,537 * 6/1989 Nakada et al. ..... 335/153
5,128,641 * 7/1992 Posey ..... 335/205
5,233,322 * 8/1993 Posey ..... 335/151

* cited by examiner

*Primary Examiner*—Lincoln Donovan

(57) ABSTRACT

An apparatus and method of proximity switch/sensor based generally on a balanceable magnetic pole array. The magnetic pole array contains at least four poles with optional ferromagnetic shunt(s). The proximity of a shunt to a magnetic pole array determines whether the array is balanced or unbalanced. A balanced array is one with a zone where the vector sum of magnetic fields emanating from the array's poles can be made to approach zero. A sensor such as a reed switch is placed in the balanced zone. When the balance of the array is disturbed by the application of one or multiple shunts, the resulting finite magnetic field vector along with the resulting magnetic flux, activates the sensor. This approach can be implemented in a variety of array structures that offer implementation of a variety of logical functions. Multiple shunts and their proximity to the array are used as the logical function's inputs and the sensor's state as the logical function's output.

19 Claims, 10 Drawing Sheets

MULTIFACETED BALANCED MAGNETIC PROXIMITY SENSOR

FIELD OF INVENTION

This invention relates to a magnetic proximity sensor with novel features. It is based on a magnetic pole array, which exhibits a balanced magnetic field in one state and unbalanced magnetic field in the opposite state. The transition from one state to the other is accomplished with a minimal sized ferromagnetic substance(s) (magnetic shunt) either added or removed from strategic places on the magnetic pole array. The sensors may perform logical functions, primarily when multiple shunts are used.

DESCRIPTION OF PRIOR ART

Magnetic proximity sensing has been used for many years. There are many different magnetic proximity sensor concepts in use today including static threshold, transient, electromagnetic, and solid-state. The list of prior art for magnetic proximity sensing applications is very long and includes security systems, automation, instrumentation, etc.

The magnetic proximity sensor category of the instant invention is best characterized as the static threshold type using a magnet as part of the mechanism. Typically in this sensor category, a sensing device such as a reed switch, coil, Hall effect or other solid-state device is used for sensing the strength of the magnetic field or the resulting magnetic flux flow.

Most proximity sensors require two devices, one attached to each of the two elements (physical entities) whose relative proximity to each other is being sensed. These devices typically comprise a permanent magnet opposite a reed switch as is commonly used in home security systems. These devices are substantial in size and are therefore undesired for some applications. U.S. Pat. No. 4,745,383 (Zovath et al.) houses the magnet and switch in one device and responds to the proximity of a ferromagnetic shunt-like element. The flux follows two independent paths, one through each side of the pivoting armature. The ferromagnetic external element attenuates the flux through the latched side of a pivoting armature and allows the force in the other side of the armature to tilt the armature to the other position. The limitations of this approach include that the pivoting armature is a moving part, that there is the necessity of forming several relatively precise parts, and that it requires alignment during fabrication. U.S. Pat. No. 4,858,622 (Osterweil) also consolidates both the permanent magnet and the reed switch in one device and a small ferromagnetic shunt constitutes the other device. This proximity sensor overcomes the problem of both devices being bulky and allows a small and unobtrusive device (the shunt) to be attached to the mobile element in a given application. However, U.S. Pat. No. 4,858,622 (Osterweil) is based on employing a magnetic shunt for attenuation of the magnetic field in the area where a magnetic field sensor (reed switch) is located. While the magnet generating the magnetic field and the sensor are fixed in space relative to each other, the removal or replacement of the shunt determines the sensor's response. The shunt is made of a high permeability ($\mu$) ferromagnetic material, usually soft iron, and is placed across the magnet poles. As long as the ferromagnetic material is sufficiently large to completely shunt the magnetic flux, the remaining external field emanating from these poles will be negligible and undetectable by a common sensor such as a reed switch. When the shunt is removed, the magnetic field is restored in the air gap between the poles and the magnetic sensor (the reed switch) is activated. In the existing art, the reed switch is activated when the shunt positioned between the magnet's poles and the reed switch is removed. For repeatable production and reliable performance, the shunt is placed against the magnet in a space between the magnet and the reed switch. One embodiment of U.S. Pat. No. 4,858,622 (Osterweil) shows the reed switch and the magnet on the same side of the shunt. However, this embodiment is very sensitive as to the relative position of the magnet and the switch and will require a complicated alignment procedure in the course of production. U.S. Pat. No. 5,929,731 (Jackson) requires a magnetic element in both devices of the proximity sensor and a multitude of switching elements. It does not meet the objective of having one of the two devices small and unobtrusive. U.S. Pat. No. 5,877,664 (Jackson) is another magnetic field sensing device and can be implemented in the instant invention instead of the reed switch or other sensors.

SUMMARY OF THE INVENTION

The concepts of existing art are based on employing two devices of significant size that encumber the moving element whose proximity to another element is being monitored. Other approaches, like U.S. Pat. No. 4,858,622 (Osterweil), have the deficiency of inactive sensing of the proximity sensor's normal state, as well as inconvenient shunt access.

The instant invention applies the properties of magnetism in a novel manner. A magnetic pole array is constructed in a manner that defines a balanced zone in which all magnetic field vectors of the individual poles of the magnetic pole array substantially cancel each other out. A reed switch is placed in the balanced zone. While the balance is maintained, the sensor is inactive. At least one shunt placed in designated locations of the balanced magnetic pole array disrupts the balance and causes a magnetic field aggregate vector to reach a finite value and activate the sensor. If a balanced magnetic pole array already includes shunts, removal of at least one shunt from the magnetic pole array will also disrupt the balance. When the balance is disrupted, the reed switch is activated.

The primary objectives of the instant invention is to allow a small device (a shunt) to be attached to a moving element whose proximity to the element containing the magnetic pole array and reed switch is being monitored and the sensor (reed switch) is active in its normal state. This novel approach to proximity sensor design in its category offers several advantages. The cancellation of the magnetic field aggregate vector in the balanced zone offers a large field strength ratio between the balanced and the unbalanced state which allows the use of a very sensitive switch, offers a robust design for moderate component tolerances, and reduces the shunt size and mass. The active mode feature in the normal state offers essentially a self-test for the proximity sensor, as well as a more dependable system approach for security and safety uses. The ability to apply multiple shunts to a single magnetic pole array with logical functional relationships between them opens the possibility of a variety of new applications for single proximity sensor usage. For example, a double door using a single magnetic pole array and reed switch on or in the doorframe and with one small shunt on each door, can activate an alarm when either door is opened (OR function), when both doors are open simultaneously (AND function), or when one door is open while the other is closed (Exclusive OR function). An additional advantage of the balanced magnetic pole array approach is the ability to offset the balance in a controlled manner and change the threshold of activation position.

DESCRIPTION OF THE EMBODIMENTS

Figure 1:
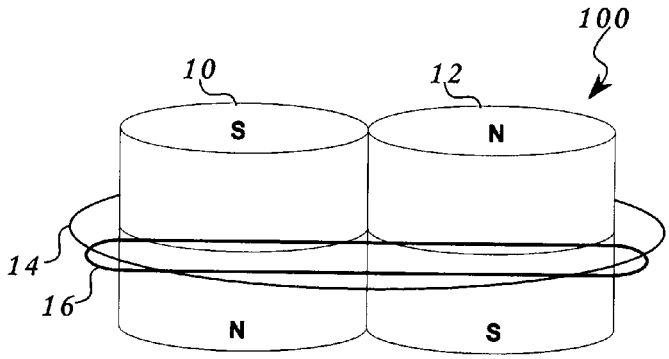
FIG. 1 shows embodiment 100 of a proximity sensor in a balanced state and the orientation of two magnets in a simple magnetic pole array to illustrate the equatorial plane and the relative placement of sensor switch(es)
Figure 2:
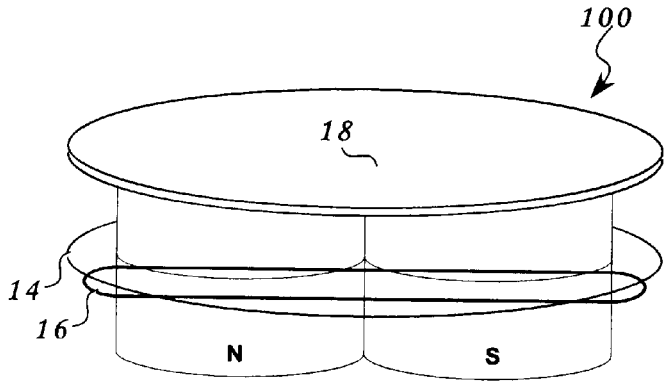
FIG. 2 shows embodiment 100 of the proximity sensor in an unbalanced state with the relative positioning of a shunt on two poles of the magnetic pole array.
Figure 4A:
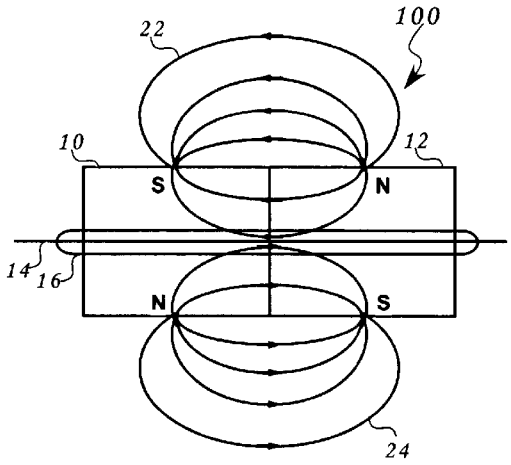
FIG. 4(*a*) and FIG. 4(*b*) show embodiment 100 of the proximity sensor in a balanced state with the emphasis on the magnetic flux flow.
Figure 4B:
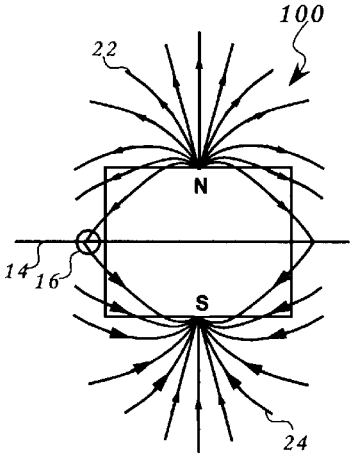
Figure 21:
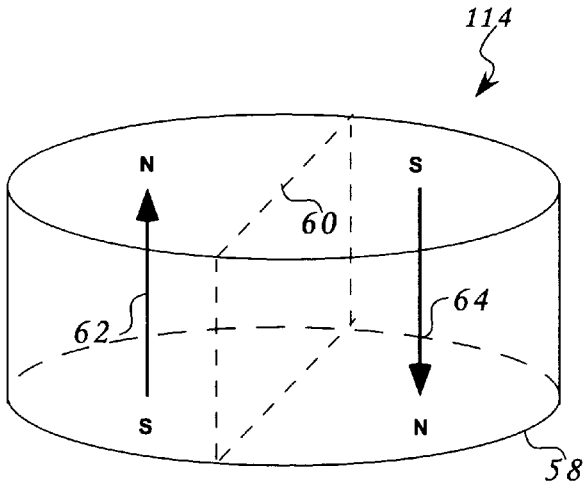
FIG. 21 shows an optional magnetic pole array that is equivalent to the magnetic pole array in embodiment 100 of the proximity sensor using a single multi-pole magnet.

The magnetic pole array of the instant invention embodiment 100 is shown in FIG. 1. The magnetic pole array consists of two magnets (10) and (12) each with a North Pole and a South Pole. This magnetic pole array is equivalent to a four pole axially magnetized magnet shown in FIG. 21. The magnets are positioned next to each other so that the South Pole of one faces the same direction as the North Pole of the other. In this position, the two magnets attract and, in fact, can adhere to each other without external support. The attraction forces are due to the magnetic flux (22) and (24) of FIG. 4(*a*) that flows between the poles through two air gaps (upper and lower). A plane that is defined by the center cross section of the two magnets, the "equatorial" plane (14), exhibits a zone where the horizontal magnetic field is canceled (the field vector sum approaches zero). The canceling of the magnetic field shown in FIG. 4(*a*), is due to the equal and opposing field vectors, a canceling flux (22) and (24) emanating from the two poles above the plane and the two poles below the plane, respectively. FIG. 4(*a*) and FIG. 4(*b*) illustrate the placement of a magnetic field sensing reed switch (16) on the equatorial plane (14) where the fields cancel and the switch is therefore not activated. This novel approach allows implementation of multiple sensors. A reed switch-type sensor is very suitable because it requires no external power. Multiple sensors (reed switches) must all be located in the balanced zone of the equatorial plane (14). However, it is understood that magnetic sensor types other than reed switches may be employed without departing from the scope and/or spirit of the instant invention. Any magnetic sensor(s), such as a Hall effect sensor, placed with the appropriate orientation in the balanced zone of the equatorial plane will perform equally well.

Figure 5A:
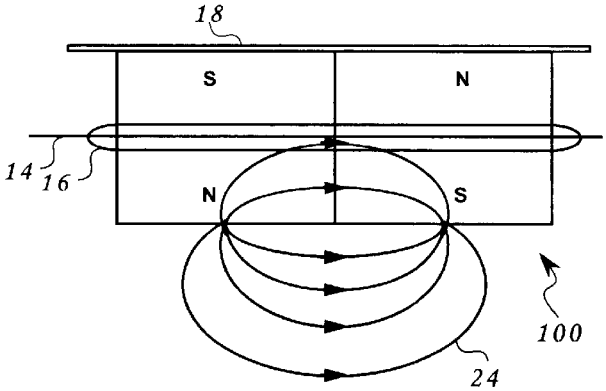
FIG. 5(*a*) and FIG. 5(*b*) show embodiment 100 of the proximity sensor in an unbalanced state with the emphasis on the magnetic flux flow as affected by one shunt.
Figure 5B:
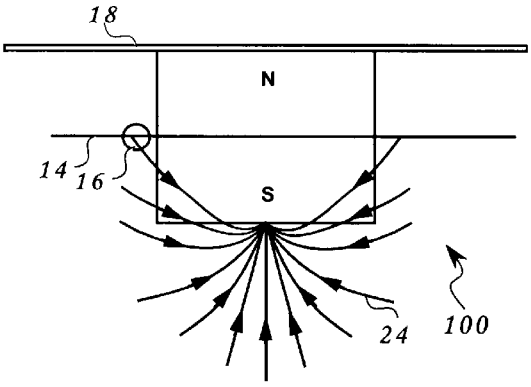

When a low reluctance (high $\mu$) shunt (18) is introduced to the two poles above the equatorial plane, as shown in FIG. 5(*a*) and FIG. (*b*), the magnetic flux flow is concentrated through the shunt. Therefore, a very minimal magnetic flux travels through the space that previously conducted the flow in the relatively high reluctance (low $\mu$) air gap. This causes a disruption of the field vector balance on the equatorial plane (14) and the sensor (16) located in the equatorial plane is thereby exposed to the magnetic flux (24) which emanates from the two poles below the equatorial plane. Therefore, when the shunt (18) is present, the sensor (16) is activated.

Implementation using all magnetic sensor types and models, as well as magnetic pole arrays, are subject to quantitative evaluation relating to the sensor's sensitivity and hysteresis, as well as the intensity of the magnetic field with and without the shunt. The magnetic field in the unbalanced state must be strong enough to activate the sensor within a given threshold and must be weak enough in the balanced state to deactivate the same sensor.

The sensor (16) is activated in the safe condition of the alarm system when the shunt (18) is present and deactivated when the shunt (18) is removed—the alert condition. This constitutes an active state for safe condition and inactive (passive) state for alert condition. This concept is more reliable than the previous art and therefore more desired.

Figure 3:
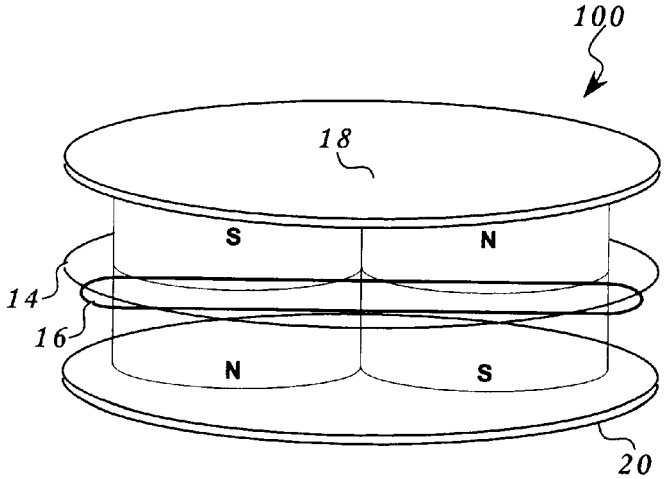
FIG. 3 shows embodiment 100 of the proximity sensor in a balanced state with the relative positioning of the described two shunts on the described two magnets magnetic pole array. This dual proximity sensor configuration performs the Exclusive OR function.
Figure 6A:
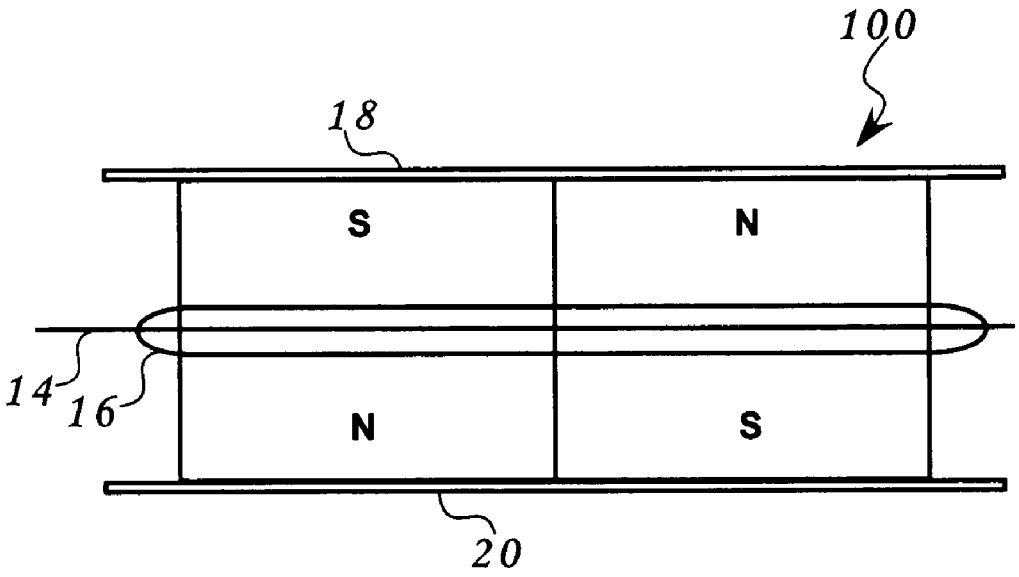
FIG. 6(*a*) and FIG. 6(*b*) show embodiment 100 of the proximity sensor in a balanced state with the emphasis on the magnetic flux flow or lack thereof as affected by two shunts.
Figure 6B:
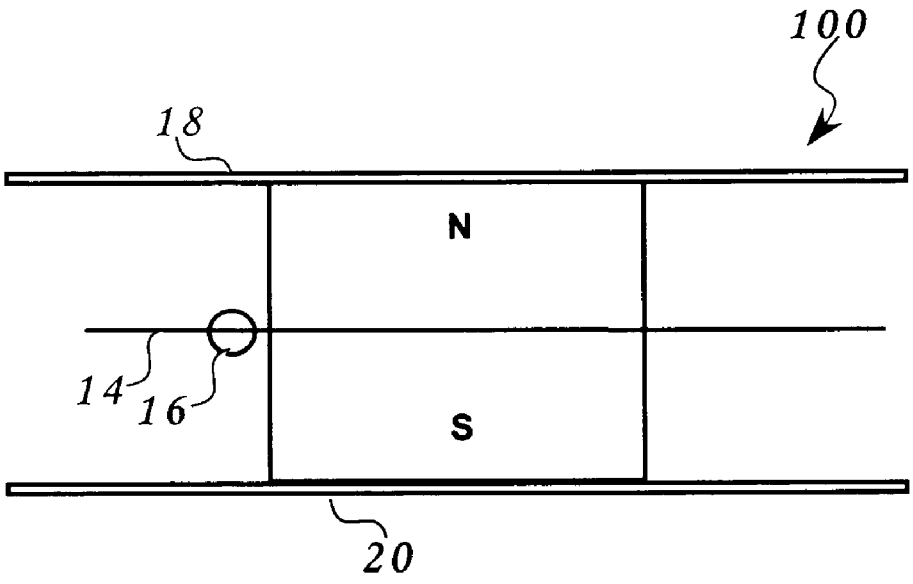

FIGS. 3, 6(*a*), and 6(*b*) show the same embodiment 100 using two shunts (18) and (20) which connote an Exclusive OR function. While both shunts (18) and (20) are present the sensor is inactive because of the low flux flow (almost nonexistent) from the balanced magnetic pole array at the equatorial plane which is best illustrated in FIG. 6(*a*). Removal of either of the shunts (18) or (20) while the other remains present will activate the sensor as described above and illustrated in FIG. 5(*a*). Removal of both shunts will reconstitute the balanced state of FIGS. 1 and 4(*a*) and deactivate the sensor. This corresponds to the logical function Exclusive OR/NOR where shunt removal/restoral is the logical input and sensor activation is the logical output.

Figure 7A:
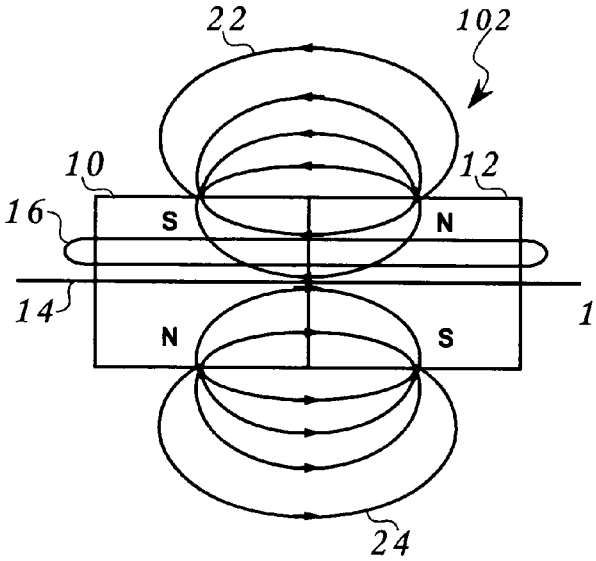
FIG. 7(*a*) and FIG. 7(*b*) show embodiment 102 of the proximity sensor, similar to embodiment 100, in an unbalanced state due to reed switch offset from the equatorial plane with emphasis on the magnetic flux flow.
Figure 7B:
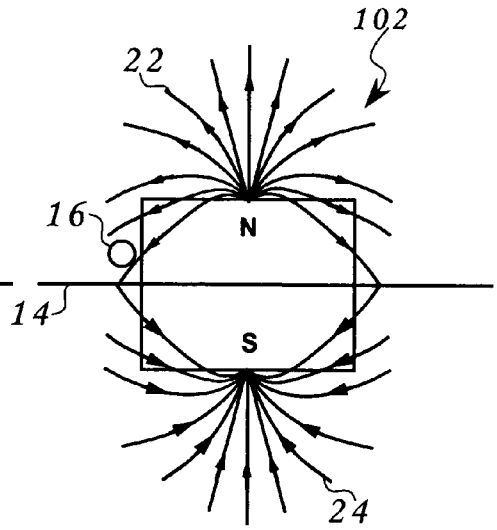
Figure 8A:
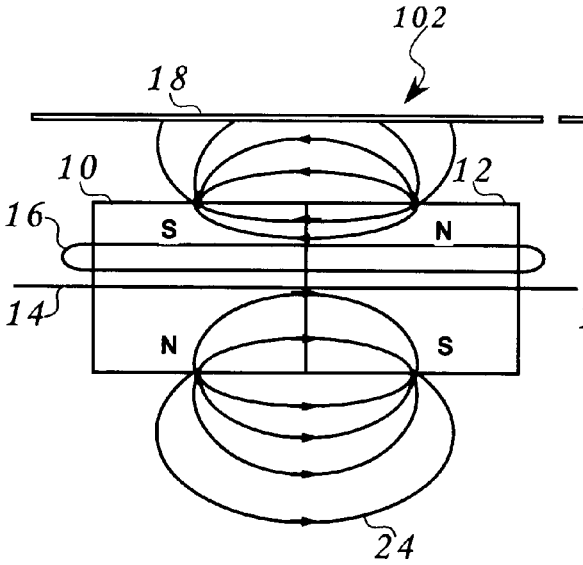
FIG. 8(*a*) and FIG. 8(*b*) show embodiment 102 of the proximity sensor in a balanced state due to reed switch offset from the equatorial plane and affected by one shunt at close distance to the magnetic pole array. The emphasis is on the magnetic flux flow.
Figure 8B:
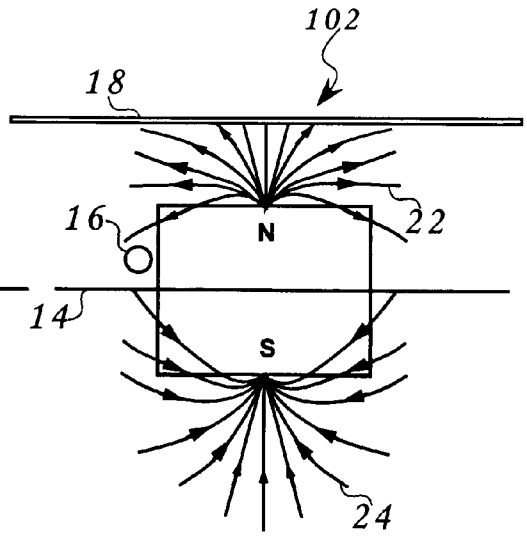

FIG. 7(*a*) and FIG. 7(*b*) illustrate embodiment 102 of the proximity sensor configuration where the reed switch is placed above the equatorial plane where the field is not completely balanced. The introduction of a shunt, FIG. 8(*a*) and FIG. 8(*b*), at a location above the top magnetic pole array poles will reduce the magnetic field emanating from these poles. This field will diminish as the shunt is brought closer to the poles. At some point, before reaching the poles, the field emanating from the top two poles will balance the field emanating from the bottom two poles at the location of the sensor (16) thus the reed switch will be deactivated.

Figures 9A, 9B:
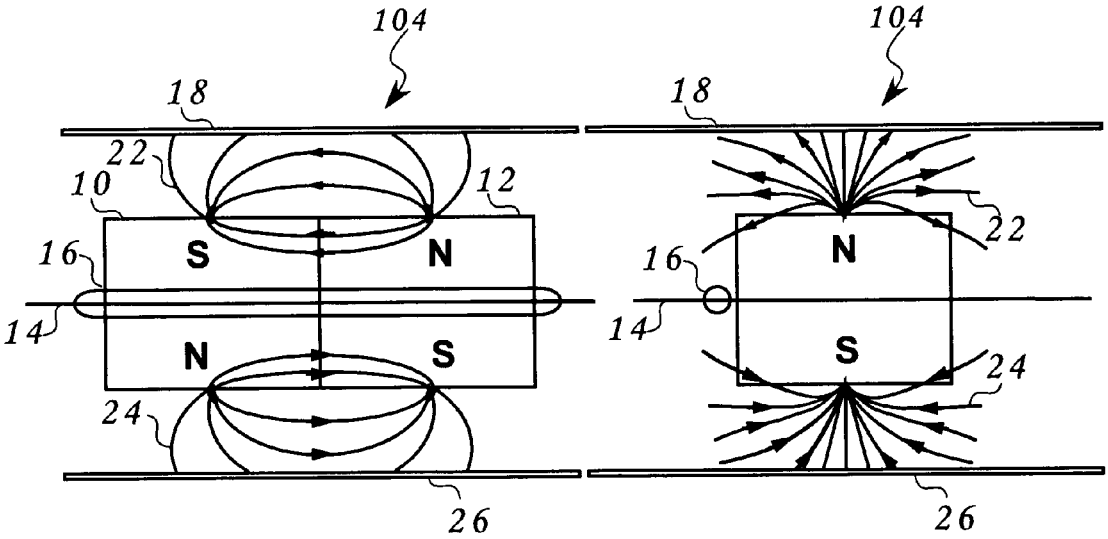
FIG. 9(*a*) and FIG. 9(*b*) show embodiment 104 of the proximity sensor, similar to embodiment 100, in a balanced state as affected by two shunts at close distance to the magnetic pole array. The emphasis is on the magnetic flux flow.

FIG. 9(*a*) and FIG. 9(*b*) illustrate embodiment 104 of the proximity sensor configuration that deactivates the reed switch when the shunt approaches the poles from a distance as in embodiment 102 in FIGS. 7(*a*), 7(*b*), 8(*a*), and 8(*b*). This approach balances the magnetic pole array by a second shunt applied at a distance to the bottom poles while the reed switch remains in the equatorial plane.

Figure 10:
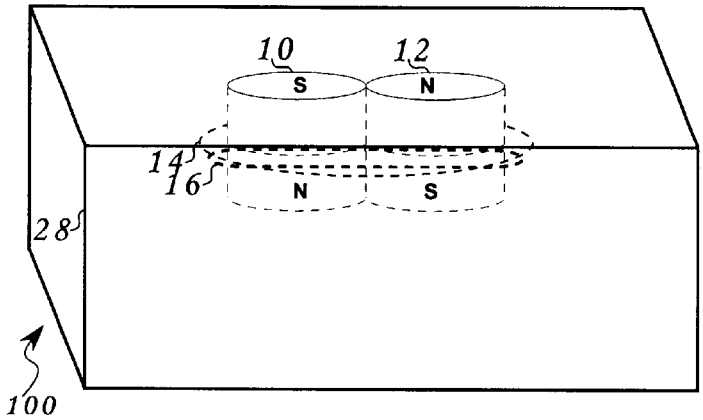
FIG. 10 shows embodiment 100 of the proximity sensor in a balanced state with the emphasis on mounting of the proximity sensor flush with a panel of an enclosure, doorframe, etc.
Figure 11:
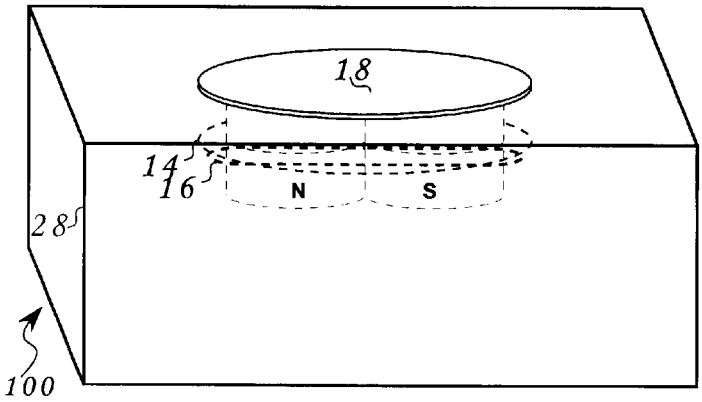
FIG. 11 shows embodiment 100 of the proximity sensor in an unbalanced state with the emphasis on mounting of the proximity sensor flush with a panel of an enclosure, doorframe, etc. The shunt causing the unbalance is external to the enclosure.
Figure 12:
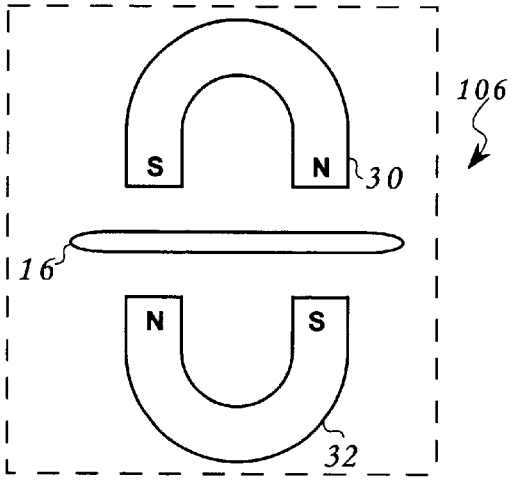
FIG. 12 shows embodiment 106 of the proximity sensor an example of the magnetic pole array in a balanced state using two horseshoe magnet elements and the reed switch's relative position.
Figure 13:
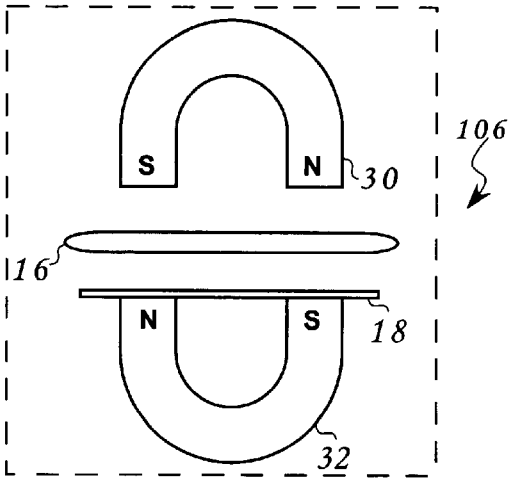
FIG. 13 shows embodiment 106 of the proximity sensor an example of the magnetic pole array in an unbalanced state using two horseshoe magnet elements and the reed switch's relative position. The unbalance affecting shunt is shown on the bottom magnet.
Figure 14:
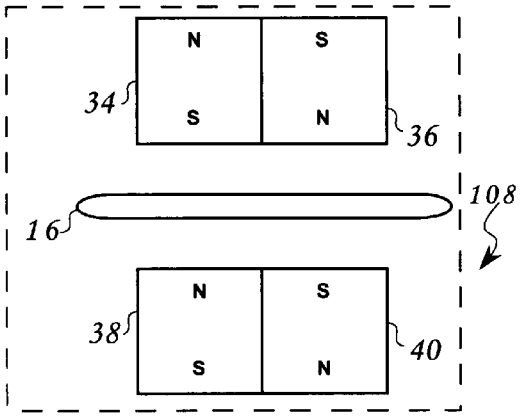
FIG. 14 shows embodiment 108 of the proximity sensor an example of the magnetic pole array in a balanced state using four magnetic elements and the reed switch's relative position.
Figure 15:
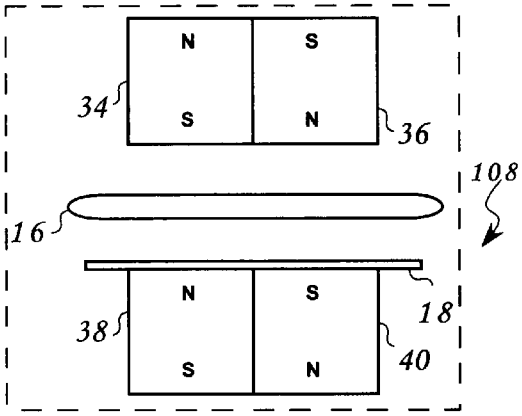
FIG. 15 shows embodiment 108 of the proximity sensor an example of the magnetic pole array in an unbalanced state using four magnet elements and the reed switch's relative position. The unbalance affecting shunt is shown on the bottom magnet set.
Figure 16:
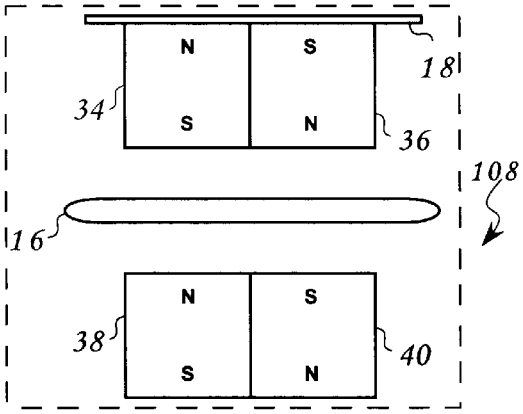
FIG. 16 shows embodiment 108 of the proximity sensor an example of the magnetic pole array in an unbalanced state using four magnet elements and the reed switch's relative position. The unbalance affecting shunt is shown on top of the top magnet set.

The opening in the enclosure (28), FIG. 10, embodiment 100 allows the two poles of magnets (10) and (12), shown above the equatorial plane (14) in the illustration, as they penetrate through the enclosure's wall. FIG. 11 illustrates the exposed poles covered by the shunt (18) outside the enclosure (28). These two poles retain the shunt and the reed switch (16) is exposed to the field emanating from the two poles below the equatorial plane (14). This demonstrates an application where an object with a small shunt mounted on or close to the bottom of the object is placed on the top surface of the enclosure (28) with the sensor active. The removal of the object from the top surface, or the moving of it substantially away from the designated place, will change the state of the sensor and activate an alarm.

Figure 22:
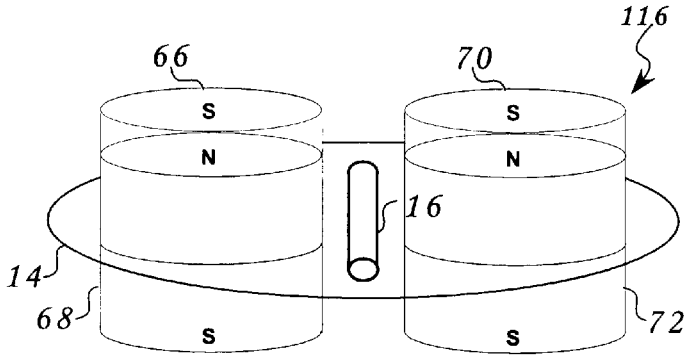
FIG. 22 shows embodiment 116 of the proximity sensor a four-magnet array configuration and a reed switch placed on the equatorial plane substantially symmetrical to and positioned between two sets of two magnets each.
Figure 23:
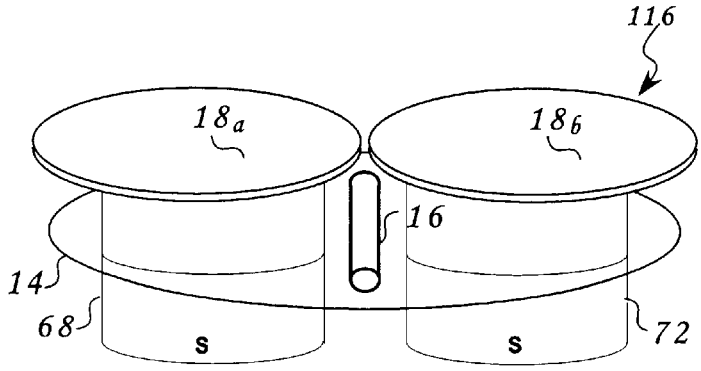
FIG. 23 shows embodiment 116 of the proximity sensor where the shunt placed on the poles of each of the two sets of two magnets. This embodiment demonstrates the AND function capability of the balanced magnetic pole array.

Embodiment 116 is an example of a combinational logic function and is shown in FIGS. 22 and 23. FIG. 22 illustrates a four-magnet (66), (68), (70), and (72) magnetic pole array configuration that is designed to perform a logical AND function. The sensor (16) is placed on the equatorial plane (14) substantially symmetrical to and between the two dual magnet sets (66), (68) and (70), (72) respectively. The magnetic field is balanced and the flux density approaches zero at the location of the sensor (16) that is therefore not activated.

FIG. 23 illustrates embodiment 116 with the addition two shunts (18*a* and 18*b*). While the two shunts (18*a* and 18*b*) are located on top of the two dual magnet sets (66), (68) and (70), (72) respectively, the magnetic pole array is unbalanced and the sensor is active. The removal of either shunt (18*a* or 18*b*) will reduce the unbalance by approximately a factor of two but the residual imbalance will keep the sensor active. Only the removal of both shunts (18*a* and 18*b*) will balance the magnetic pole array and deactivate the sensor. This demonstrates an application of an AND function as well as a negative OR function. The duality of combinational logic functions by the application of positive and negative logic is well known to those knowledgeable of the art of logic.

Figure 24:
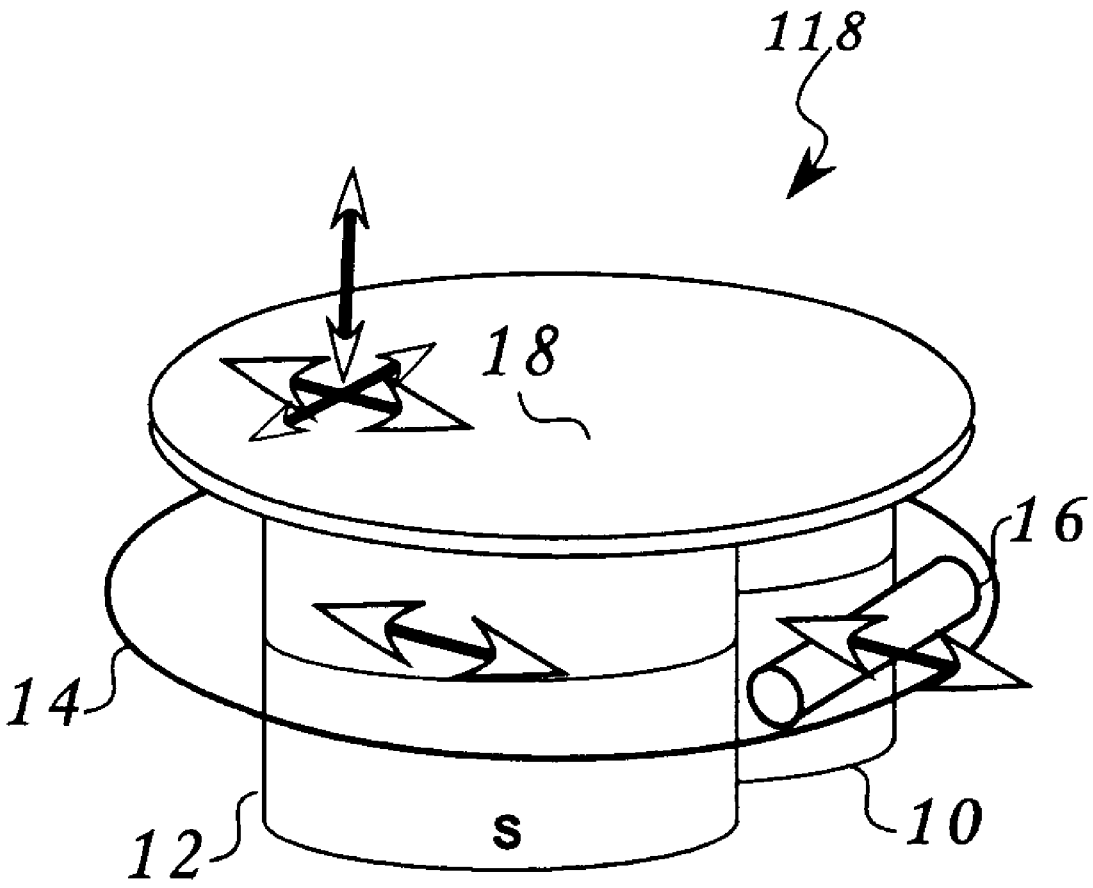
FIG. 24 shows embodiment 118 of the proximity sensor in which moving the magnetic pole array, the sensor, and the shunt relative to each other accomplishes a three input OR function.

Embodiment 118 shown in FIG. 24 is an example of a three input OR function in where removal of either of the shunts, the magnetic pole array, or the sensor will change the output state of the sensor.

The logic functions described herein are categorized as combinational logic functions. Combinational logic functions do not include memory elements. However, sequential logic functions, which include memory elements, are achieved by exploiting the hysteresis properties of the ferromagnetic material of the shunts and/or of the reed switch. An example of sequential logic function implementation is demonstrated by the embodiment 104 in FIG. 9(*a*) and FIG. 9(*b*). In the absence of the shunt (18), another shunt (26) is located at a distance from the poles so that it is far enough to disrupt the balance state at the reed switch (16) where the resultant field is strong enough to retain the active status of the reed switch (16) but not strong enough to activate an inactive reed switch (16). The hysteresis properties of a reed switch include two levels of magnetic field, upper and lower. When the magnetic field strength is above the upper level, the reed switch is activated. Only when the magnetic field strength falls below the lower level does the reed switch deactivate. While the magnetic field is between the two levels, the reed switch will maintain its last status (active or inactive). The difference between the two levels is known as magnetic hysteresis and its value varies depending on the material the reed switch is made of.

When shunt (18) is placed close to the magnetic pole array's top poles, the unbalance will create a field strong enough to activate the reed switch (16). However, when abruptly removed, the sensor will be held active by the shunt (26). This constitutes a memory feature that remembers the one time presence of the shunt (18) even after it was removed. This memory can be reset by momentary removal of the shunt (26). When the shunt (26) is replaced, the sensor will remain inactive until the shunt (18) activates it again.

Figure 17:
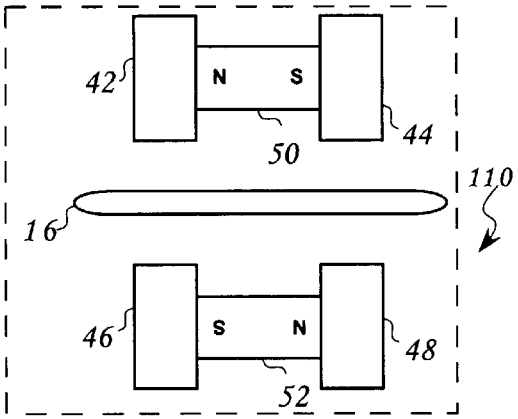
FIG. 17 shows embodiment 110 of the proximity sensor an example of the magnetic pole array in a balanced state using two magnets each with two pole-extending ferromagnetic elements and the reed switch's relative position.
Figure 18:
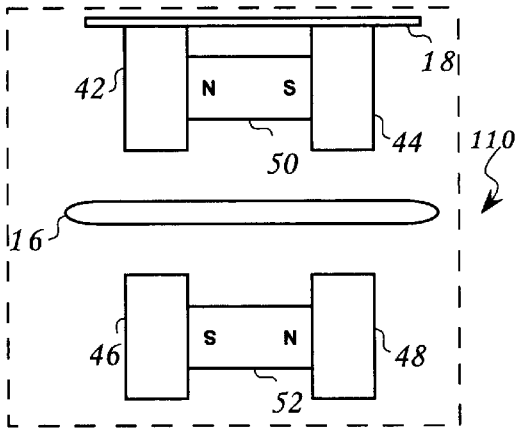
FIG. 18 shows embodiment 110 of the proximity sensor an example of the magnetic pole array in an unbalanced state using two magnets each with two pole-extending ferromagnetic elements and the reed switch's relative position. The unbalance affecting shunt is shown on top of the top magnet pole-extension set.

It is understood that other magnetic pole array configurations may be employed without departing from the scope and/or spirit of the instant invention. Many different magnetic pole array configurations are possible in which two or more magnetic fields produce a zero aggregate field at a given location. Positioning of a shunt at a strategic location, modifies some of the field components, thus disturbing the balance and resulting in a finite magnetic field at the location where previously the aggregate field was null. Examples of such magnetic pole arrays are comprised in embodiments 106 and 108 as illustrated in FIGS. 12 through 16. In addition, magnetic pole arrays can be supplemented with permanent ferromagnetic members (embodiment 110 in FIGS. 17 and 18) for particular effects. The ferromagnetic members (42), (44), (46), and (48) extend or redirect the poles of a magnet.

Figure 19:
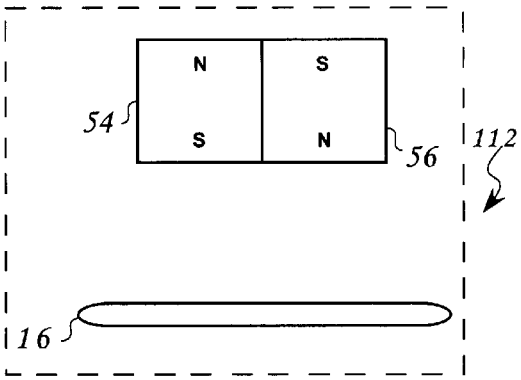
FIG. 19 shows embodiment 112 of the proximity sensor, a derivative of the balanced magnetic pole array, where the reed switch is located at a distance from the magnetic pole array where the magnetic field is too weak to activate it.
Figure 20:
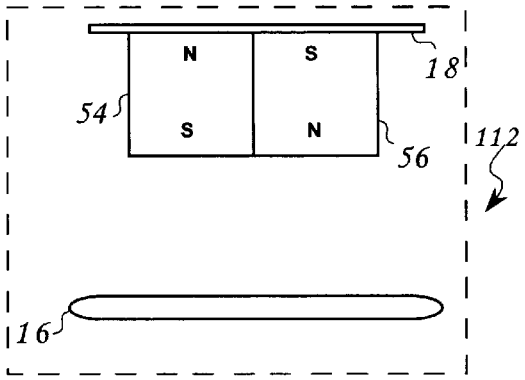
FIG. 20 shows embodiment 112 of the proximity sensor with the addition of a shunt on poles opposite the reed switch. The shunt enhances the magnetic field at the reed switch area by reducing by 50% the air gap between the magnetic pole array's two magnets.

Embodiment 112 is a magnetic pole array in which changes to the air gap size by insertion of a shunt or by shunting an air gap altogether results in an increased magnetic flux condition at a different air gap. The ratio of the flux density with and without the shunt determines the detectibility of the change. Embodiment 112 is an example illustrated in FIG. 19 and 20. The sensor (16) is placed in the air gap far enough from the magnet poles (shown below magnets (54) and (56)) so that the field is so ineffective as to be undetectable by the sensor (16). When (in FIG. 20) the shunt (18) eliminates the top air gap, the reluctance is reduced by ~50% (one air gap instead of two air gaps in series). The reduced effective reluctance results in an enhanced field in the lower air gap, which provides adequate flux concentration to activate the sensor (16).

All the magnetic pole arrays described or implied tend to attract the shunt when it is placed in close proximity to the magnetic pole array. The combination of magnetic field strength of the poles, size of the poles, size of the shunt (both area and cross-section), the shunt's flux saturation point, and the proximity of the shunt to the magnetic pole array's control the poles attraction force by the magnetic pole array and the adherence of the shunt placed close to it.

Only a few logic functions using magnetic pole array and shunts are described herein. However, it is understood that other magnetic pole arrays in conjunction with shunts that perform other combinational and/or sequential logic functions may be employed without departing from the scope and/or spirit of the instant invention.

From the description above, advantages of this proximity sensor that become evident are:

Security and safety applications benefit from an active and therefore positive safe status detection apparatus that detects the safe condition and alarms when the safe condition is lost. This feature also acts as a self-test for the apparatus itself. An alarm is triggered under several conditions of defective proximity sensor such as loss of magnetism of the magnetic pole array magnets or dislodging of the sensor from its proximity to the magnetic pole array;

The balanced magnetic field vector approach offers flux flow approaching zero in the balanced zone where the sensor is located. When the shunt is introduced or removed to disrupt the balance, depending on the chosen configuration of the magnetic pole array, the magnetic field vector intensity at the previously balanced zone increases and the sensor is activated by the increased flux flow through it. This flux flow is of a finite level in the unbalanced state compared to a level close to zero at the balanced state. This constitutes a high ratio between the balanced and unbalanced states in terms of flux flow levels and consequently create distinguishable states with a higher margin of certainty and reliability. Trade-offs of this robust detection margin are realized by attribute allocation. These diametrically opposed attributes include reed switch flux level activation, reed switch hysteresis, increase of the gap between the shunt and the magnetic pole array's poles, reduction of the shunt's size and mass, loosening of manufacturing tolerances, magnetic strength of the elements of the magnetic pole array, and a margin for component specification drift due to aging and fatigue. Exact functional relationships between these attributes are not always simple to derive mathematically. The inventor was successful in arriving at a good allocation of attributes with comfortable margins all around using empirical methods in conjunction with generic mathematical expressions for a better understanding of the behavioral trends of each magnetic pole array configuration;

The proximity sensor can be operated without power by the use of a reed switch as the sensing element in conjunction with a system that recognizes dry contact status (very common in the industry);

Although active sensing in the normal state is preferred as detailed above, this proximity sensor can be used also in a reversed mode where the sensor is inactive in the normal state and becomes active in the alarm state. This "dual mode operation" sacrifices the self-test feature mentioned above and reduces the confidence level of its performance in the normal mode, but doubles the functional application modes of this novel proximity sensor;

Multiple shunts can be applied to a single magnetic pole array of given design for execution of logic functions. Some examples of logic functions have been described earlier and they clearly open the possibility of a variety of new applications for single proximity sensor usage. With the addition of dual mode operation, the number of logic functions doubles. Each proximity sensor performs its intended function and its logical inverse function. This is based on the application of the duality principle of positive and negative logic. A positive logic AND function, for example, represents equally a negative logic OR, etc.; and Offset of the proximity sensor balance in a controlled manner enables change of threshold of the sensor activation position. This feature offers additional advantages to the balanced magnetic pole array approach for applications in which the shunt cannot be brought to a touching distance of the magnetic pole array. Such a feature could apply for monitoring items such as wallets, briefcases, and objects of art where the shunt is placed inside the monitored item.

The manner of operation of the apparatus depends on the application and the chosen configuration of the proximity sensor. The main assembly structure of the proximity sensor will typically be mounted on the most stationary element of the application (doorframe) while shunts are best mounted on the mobile elements in the application (doors). Another consideration for placement of proximity sensor components is the size of the elements in a given application and the connectivity of the proximity sensor output to the alarm system (or other data collection system) and its location. The reed switch must be wired to the alarm system and the wiring path must be well executed. The shunts should ideally rest or be placed on their respective poles of the magnetic pole array. Their placement and removal is accomplished by motion in any direction although the retention force will be strongest in the direction perpendicular to the shunt's surface. The shunts can also be suspended at a slight distance above their respective poles (close enough to offset the magnetic balance of the magnetic pole array) as in the case of a door that requires a gap between itself and the doorframe. Similarly, a wallet with a shunt inside placed on a surface (table) with a built-in magnetic pole array sensor, will have a gap between the magnetic pole array and the shunt corresponding to the thickness of the material the wallet is made of and the thickness of the table veneer if the pole does not protrude to the table's surface.

I claim:

1. An apparatus that senses proximity between physical elements, comprising:

a magnetic pole array comprised of at least one magnetic building block each containing two similar size and proximate magnets with a north pole on one end and a south pole on the other end where an imaginary line between the centers of said poles is the axis of said magnet, and where said two magnets proximate and are positioned in a manner where their axes are substantially parallel and the north pole of the first magnet is adjacent to the south pole of the second said magnet—first set of adjacent poles—and the south pole of the first magnet is adjacent to the north pole of the second said magnet—second set of adjacent poles; an imaginary plane perpendicular to the said axes and substantially centered between the first and second said sets of adjacent poles defines an equatorial plane where a magnetic field emanating from the first said set of adjacent poles is opposite in direction and close in intensity to magnetic field emanating from the second said set of adjacent poles and substantially cancel each other out—a balanced state of said magnetic fields where a net intensity of all magnetic fields emanating from said magnetic building block is negligible;

at least one magnetic sensor positioned substantially on said equatorial plane wherein said balanced state an output of said sensor is not activated due to insufficient intensity of magnetic field; and a shunt made of permeable material when placed in proximity of one said set of adjacent poles of said magnetic pole array reduces the magnetic field emanating from said set of adjacent poles and net intensity of all magnetic fields at said equatorial plane emanating from said magnetic building block is sufficient to activate the said sensor—said balanced state is changed to an unbalanced state where placement of said shunt is an input to said apparatus affecting said output.

2. The apparatus of claim 1 wherein said magnetic building block is comprised of a single functionally equivalent multi-pole magnet.

3. The apparatus of claim 1 wherein the sensor is comprised of a reed switch.

4. The apparatus of claim 1 wherein said magnetic pole array with at least one said shunt in proximity of at least one said set of adjacent poles where said magnetic pole array is in an unbalanced state at said equatorial plane arranged to be common to all said magnetic building blocks of said magnetic pole array and where removal of said shunt restores the balanced state at the equatorial plane and deactivates the said sensor.

5. The apparatus of claim 1 wherein said magnetic pole array with at least one said shunt is in proximity of at least one said set of adjacent poles where said magnetic pole array is in an unbalanced state at said equatorial plane and where another said shunt is placed in proximity of the another said set of adjacent poles restores the balanced state at the equatorial plane and deactivates the said sensor.

6. The apparatus of claim 5 wherein said magnetic building block comprises an equivalent to a horseshoe magnet where the central segment of the horseshoe is equivalent to said shunt permanently attached to one said set of adjacent poles.

7. The apparatus of claim 5 wherein said balanced state is changed to said unbalanced state of said magnetic pole array by removal of said shunt from said set of adjacent poles and thus activate said sensor.

8. The apparatus of claim 1 wherein a change between the balanced state and the unbalanced state at said equatorial plane of said magnetic pole array is comprised of at least one said magnetic building block and where said output of said sensor corresponds to at least one combinational logic function; said combinational logic function at said output is controlled by said inputs comprised of proximity of said shunts to said sets of said adjacent poles of magnetic pole array.

9. The apparatus of claim 8 wherein a change between the balanced state and the unbalanced state of said magnetic pole array at said equatorial plane corresponds to at least one combinational logic function and at least one sequential logic function where said sequential logic function is determined by the difference of said magnetic field intensity necessary for activation of said sensor and said magnetic field intensity necessary for deactivation of said sensor that establishes the dependence of subsequent state of said output on the previous state of said output and said inputs.

10. The apparatus of claim 8 wherein an additional input to said combinational logic functions comprises of the proximity of said sensor to said magnetic pole array where said magnetic field intensity emanating from said magnetic pole array diminishes with distance and causes said sensor to deactivate independently of said shunts and their proximity to respective said sets of adjacent poles.

11. The apparatus of claim 4 wherein a change between the balanced state and the unbalanced state at said equatorial plane of said magnetic pole array is comprised of at least one said magnetic building block and where said output of said sensor corresponds to at least one combinational logic function; said combinational logic function at said output is controlled by said inputs comprised of proximity of said shunts to said sets of said adjacent poles of magnetic pole array.

12. The apparatus of claim 11 wherein a change between the balanced state and the unbalanced state of said magnetic pole array at said equatorial plane corresponds to at least one combinational logic function and at least one sequential logic function where said sequential logic function is determined by the difference of said magnetic field intensity necessary for activation of said sensor and said magnetic field intensity necessary for deactivation of said sensor that establishes the dependence of subsequent state of said output on the previous state of said output and said inputs.

13. The apparatus of claim 4 wherein the unbalanced state is achieved by placement of at least one additional said shunt in proximity of said sets of said adjacent poles of said magnetic pole array and removal of other said shunts already in proximity of other said sets of said adjacent poles of said magnetic pole array.

14. The apparatus of claim 1 wherein said sensor is positioned below said equatorial plane where said fields emanating from the two said sets of adjacent poles of said magnetic building block do not cancel and where the net magnetic field intensity is adequate to have said sensor activated; as said shunt is moved towards said set of adjacent poles positioned closer to said sensor, the field intensity emanating from this pole diminishes and at some point said fields emanating from the two said sets of adjacent poles will cancel at the said sensor location where the net magnetic field intensity becomes inadequate to keep said sensor activated; the distance of said shunt from said set of adjacent poles which causes said field cancellation is dependent on the distance of said sensor from said equatorial plane.

15. A method for sensing proximity between physical elements, comprising:

configuring a magnetic pole array based on at least one magnetic building block of two similar size and proximate magnets each with a north pole on one end and a south pole on the other end where an imaginary line between the centers of said poles is the axis of said magnet, and where said two magnets proximate and are positioned in a manner where their axes are substantially parallel and the north pole of the first magnet is adjacent to the south pole of the second said magnet—first set of adjacent poles—and the south pole of the first magnet is adjacent to the north pole of the second said magnet—second set of adjacent poles; an imaginary plane perpendicular to the said axes and substantially centered between the first and second said sets of adjacent poles defines an equatorial plane where magnetic field emanating from the first said set of adjacent poles is opposite in direction and close in intensity to magnetic field emanating from the second said set of adjacent poles and substantially cancel each other out—a balanced state of said magnetic fields where a net intensity of all magnetic fields emanating from said magnetic building block is negligible;

positioning at least one magnetic sensor substantially on the said equatorial plane where in said balanced state an output of said sensor is not activated due to insufficient intensity of magnetic field; and placing a shunt made of permeable material when placed in proximity of one said set of adjacent poles of said magnetic pole array thus reducing the magnetic field emanating from said set of adjacent poles and net intensity of all magnetic fields at said equatorial plane emanating from said magnetic building block becomes sufficient to activate the said sensor—said balanced state is changed to an unbalanced state where placement of said shunt is an input to said apparatus affecting said output.

16. The method of claim 15 wherein said magnetic pole array with at least one said shunt is in proximity of at least one said set of adjacent poles and where said magnetic pole array is in an unbalanced state at said equatorial plane while said sensor is active and where by removing said shunt, said balanced state at the equatorial plane is restored and said sensor is deactivated.

17. The method of claim 15 wherein said magnetic pole array with at least one said shunt in proximity of at least one said set of adjacent poles where said magnetic pole array is in an unbalanced state at said equatorial plane while said sensor is active and where another said shunt placed in proximity of the other said set of adjacent poles restores the balanced state at the equatorial plane and deactivates the said sensor.

18. The method of claim 15 wherein said magnetic pole array with at least one said shunt in proximity of at least one said set of adjacent poles where said magnetic pole array is in a balanced state at said equatorial plane while said sensor is inactive and where by removing at least one said shunt, said balanced state at the equatorial plane becomes unbalanced and said sensor is activated.

19. An apparatus that senses proximity between physical elements, comprising:

a magnetic pole array comprised of at least one magnetic building block of two similar size and proximate magnets each with a north pole on one end and a south pole on the other end where an imaginary line between the centers of said poles is the axis of said magnet, and where said two magnets proximate and are positioned in a manner where their axes are substantially parallel and the north pole of the first magnet is adjacent to the south pole of the second said magnet—first set of adjacent poles—and the south pole of the first magnet is adjacent to the north pole of the second said magnet—second set of adjacent poles; and at least one magnetic sensor positioned substantially on the plane defined by said axes of said magnetic building block at a distance from one said set of adjacent poles of the magnetic pole array where the magnetic field emanating from said set of adjacent poles is insufficient for said output of said sensor to be active; and a shunt made of permeable material that when paced in proximity of the second said set of adjacent poles causes the magnetic field emanating from the first said set of adjacent poles to increase sufficiently to activate said sensor's output.

* * * * *